US007249637B2

(12) United States Patent
Hayes et al.

(10) Patent No.: US 7,249,637 B2
(45) Date of Patent: Jul. 31, 2007

(54) METHOD AND DEVICE TO CLAMP CONTROL LINES TO TUBULARS

(75) Inventors: Michael Hayes, Houston, TX (US); Troy F. Hill, Lafayette, LA (US); Timothy Bedore, Woodlands, TX (US); Jimmy L. Hollingsworth, Lafayette, LA (US); David M. Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 368 days.

(21) Appl. No.: 11/037,800

(22) Filed: Jan. 18, 2005

(65) Prior Publication Data

US 2005/0161227 A1 Jul. 28, 2005

Related U.S. Application Data

(63) Continuation-in-part of application No. 10/625,840, filed on Jul. 23, 2003, now Pat. No. 7,073,598, which is a continuation of application No. 09/860,127, filed on May 17, 2001, now Pat. No. 6,742,596, application No. 11/037,800, which is a continuation-in-part of application No. 10/611,565, filed on Jul. 1, 2003, now Pat. No. 7,043,814, which is a continuation of application No. 09/486,901, filed as application No. PCT/GB98/02582 on Sep. 2, 1998, now Pat. No. 6,591,471.

(60) Provisional application No. 60/536,800, filed on Jan. 15, 2004.

(51) Int. Cl.
*E21B 19/14* (2006.01)

(52) U.S. Cl. ..... 166/385; 166/77.1; 166/85.5; 166/241.5; 166/380

(58) Field of Classification Search ..... None
See application file for complete search history.

(56) References Cited

U.S. PATENT DOCUMENTS 1,541,669 A 6/1925 Summers (Continued)

FOREIGN PATENT DOCUMENTS

CA 2 284 428 4/2001

(Continued)

OTHER PUBLICATIONS

PCT Search Report, International Application No. PCT/US2005/001326, dated May 3, 2005.

(Continued)

*Primary Examiner*—Zakiya W. Bates
(74) *Attorney, Agent, or Firm*—Patterson & Sheridan, LLP

(57) ABSTRACT

The inventions relates to an apparatus for connecting a control line to a tubular string. In one embodiment, the apparatus includes a guide boom pivotable around a location adjacent the string and with a guide member at an end thereof to guide the control line. The apparatus further includes a clamp boom that is independently pivotable and includes a clamp housing at an end thereof for clamping the control line against the tubular string. The guide boom and the clamp boom each have a center line which is substantially aligned with the center line of the tubing string permitting the control line to be aligned adjacent the tubular string prior to clamping.

38 Claims, 4 Drawing Sheets

U.S. PATENT DOCUMENTS

| | | | | |
|---|---|---|---|---|
| 2,063,361 | A | | 12/1936 | Baash |
| 2,298,507 | A | | 10/1942 | Penick et al. |
| 2,589,159 | A | | 3/1952 | Stone |
| 2,934,148 | A | | 4/1960 | Allaire |
| 3,063,509 | A | | 11/1962 | Guier |
| 3,099,323 | A | | 7/1963 | Kelley |
| 3,188,708 | A | | 6/1965 | O'Haver |
| 3,287,776 | A | | 11/1966 | Brown |
| 3,330,354 | A | | 7/1967 | Chamblee |
| 3,675,278 | A | | 7/1972 | Powell |
| 3,748,702 | A | | 7/1973 | Brown |
| 3,883,009 | A | * | 5/1975 | Swoboda et al. ..... 414/740 |
| 4,035,012 | A | | 7/1977 | Guier |
| 4,126,348 | A | | 11/1978 | Palmer |
| RE29,995 | E | | 5/1979 | Guier |
| 4,208,158 | A | | 6/1980 | Davies et al. |
| 4,209,066 | A | | 6/1980 | Watson |
| 4,326,745 | A | | 4/1982 | Guier |
| 4,354,706 | A | | 10/1982 | Coyle, Sr. |
| 4,381,584 | A | | 5/1983 | Coyle, Sr. |
| 4,396,216 | A | | 8/1983 | Hamilton |
| 4,417,846 | A | | 11/1983 | Elliston |
| 4,421,447 | A | | 12/1983 | Gudgel et al. |
| 4,489,794 | A | | 12/1984 | Boyadjieff |
| 4,523,645 | A | | 6/1985 | Moore |
| 4,600,054 | A | | 7/1986 | Miller et al. |
| 4,643,259 | A | | 2/1987 | Zeringue, Jr. |
| 4,715,456 | A | | 12/1987 | Poe, Jr. et al. |
| 4,800,968 | A | | 1/1989 | Shaw et al. |
| 4,843,945 | A | | 7/1989 | Dinsdale |
| 4,867,236 | A | | 9/1989 | Haney et al. |
| 5,083,356 | A | | 1/1992 | Gonzalez et al. |
| 5,335,756 | A | | 8/1994 | Penisson |
| 5,484,040 | A | | 1/1996 | Penisson |
| 5,609,226 | A | | 3/1997 | Penisson |
| 5,848,647 | A | | 12/1998 | Webre et al. |
| 6,056,060 | A | | 5/2000 | Abrahamsen et al. |
| 6,089,338 | A | | 7/2000 | Bouligny, Jr. |
| 6,131,664 | A | | 10/2000 | Sonnier |
| 6,192,981 | B1 | | 2/2001 | Boquet et al. |
| 6,237,684 | B1 | | 5/2001 | Bouligny, Jr. et al. |
| 6,378,399 | B1 | | 4/2002 | Bangert |
| 6,422,311 | B1 | | 7/2002 | Jansch |
| 6,591,471 | B1 | | 7/2003 | Hollingsworth et al. |
| 6,742,596 | B2 | | 6/2004 | Haugen |
| 6,920,931 | B1 | | 7/2005 | Webre et al. |
| 7,044,216 | B2 | | 5/2006 | Otten et al. |
| 2002/0096337 | A1 | | 7/2002 | Bouligny et al. |
| 2003/0066718 | A1 | | 4/2003 | Buck |
| 2003/0173117 | A1 | | 9/2003 | Mason et al. |
| 2004/0035587 | A1 | | 2/2004 | Hollingsworth et al. |
| 2004/0069500 | A1 | | 4/2004 | Haugen |
| 2005/0000696 | A1 | | 1/2005 | McDaniel et al. |
| 2005/0161225 | A1 | | 7/2005 | Cole et al. |
| 2005/0161230 | A1 | | 7/2005 | Webre et al. |

FOREIGN PATENT DOCUMENTS

| | | |
|---|---|---|
| DE | 19814033 | 10/1999 |
| EP | 0 479 583 | 4/1992 |
| FR | 2 658 972 | 8/1991 |
| GB | 2 014 215 | 8/1979 |
| GB | 2 355 030 | 4/2001 |
| WO | WO 99/10674 | 3/1999 |
| WO | WO 01/69034 | 9/2001 |

OTHER PUBLICATIONS

Dual Elevator on KTB Rig, Bohranlage, Bohrplatz und Bohriochsicherungssystem, pp. 449-450.

* cited by examiner

METHOD AND DEVICE TO CLAMP CONTROL LINES TO TUBULARS

CROSS-REFERENCE TO RELATED APPLICATIONS

This application claims benefit of U.S. provisional patent application Ser. No. 60/536,800, filed Jan. 15, 2004. This application is also a continuation-in-part of U.S. patent application Ser. No. 10/625,840, filed Jul. 23, 2003 now U.S. Pat. No. 7,073,598, which is a continuation of application Ser. No. 09/860,127, filed on May 17, 2001, now U.S. Pat. No. 6,742,596. This application is also a continuation-in-part of co-pending U.S. patent application Ser. No. 10/611,565, filed Jul. 1, 2003 now U.S. Pat. No. 6,591,471, which is a continuation of application Ser. No. 09/486,901, filed on May 19, 2000, now U.S. Pat. No. 6,591,471, filed as U.S.C. § 371 of International Application No. PCT/GB98/02582, filed Sep. 2, 1998 which claims priority to GB 9718543.3, filed on Sep. 2, 1997. Each of the aforementioned related Patents and patent applications is herein incorporated by reference in its entirety.

BACKGROUND OF THE INVENTION

1. Field of the Invention

The present invention relates to the makeup of tubular strings at the surface of a well. More particularly, the invention relates to making up strings and running the strings into the well along with a control line or signal transmission line. More particularly still, the invention relates to methods and apparatus for facilitating the clamping of a control line or signal transmission line to a tubular string prior to lowering the string, clamp, and such line into the well.

2. Description of the Related Art

Strings of pipe are typically run into a wellbore at various times during the formation and completion of a well. A wellbore is formed for example, by running a bit on the end of the tubular string of drill pipe. Later, larger diameter pipe is run into the wellbore and cemented therein to line the well and isolate certain parts of the wellbore from other parts. Smaller diameter tubular strings are then run through the lined wellbore either to form a new length of wellbore therebelow, to carry tools in the well, or to serve as a conduit for hydrocarbons gathered from the well during production.

As stated above, tools and other devices are routinely run into the wellbore on tubular strings for remote operation or communication. Some of these are operated mechanically by causing one part to move relative to another. Others are operated using natural forces like differentials between downhole pressure and atmospheric pressure. Others are operated hydraulically by adding pressure to a column of fluid in the tubular above the tool. Still others need a control line to provide either a signal, power, or both in order to operate the device or to serve as a conduit for communications between the device and the surface of the well. Control lines (also known as umbilical cords) can provide electrical, hydraulic, or fiber optic means of signal transmission, control and power.

Because the interior of a tubular string must be kept clear for fluids and other devices, control lines are often run into the well along an outer surface of the tubular string. For example, a tubular string may be formed at the surface of a well and, as it is inserted into the wellbore, a control line may be inserted into the wellbore adjacent the tubular string. The control line is typically provided from a reel or spool somewhere near the surface of the well and extends along the string to some component disposed in the string. Because of the harsh conditions and non-uniform surfaces in the wellbore, control lines are typically fixed to a tubular string along their length to keep the line and the tubular string together and prevent the control line from being damaged or pulled away from the tubular string during its trip into the well.

Control lines are typically attached to the tubular strings using clamps placed at predetermined intervals along the tubular string by an operator. Because various pieces of equipment at and above well center are necessary to build a tubular string and the control line is being fed from a remotely located reel, getting the control line close enough to the tubular string to successfully clamp it prior to entering the wellbore is a challenge. In one prior art solution, a separate device with an extendable member is used to urge the control line towards the tubular string as it comes off the reel. Such a device is typically fixed to the derrick structure at the approximate height of intended engagement with a tubular traversing the well center, the device being fixed at a significant distance from the well center. The device is telescopically moved toward and away from well center when operative and inoperative respectively. The device must necessarily span a fair distance as it telescopes from its out of the way mounting location to well center. Because of that the control line-engaging portion of the device is difficult to locate precisely at well center. The result is often a misalignment between the continuous control line and the tubular string making it necessary for an operator to manhandle the control line to a position adjacent the tubular before it can be clamped.

There is a need therefore for an apparatus which facilitates the clamping of the control line to a tubular string at the surface of a well. There is additionally a need for an apparatus which will help ensure that a control line is parallel to the center line of a tubular string as the control line and the tubular string come together for clamping.

SUMMARY OF THE INVENTION

In one embodiment, the apparatus includes a guide boom pivotable around a location adjacent the string and with a guide member at an end thereof to guide the control line. The apparatus further includes a clamp boom that is independently pivotable and includes a clamp housing at an end thereof for carrying and locating a clamp to clamp the control line against the tubular string. The guide boom structure and the clamp boom structure each have a center line which is substantially aligned with the center line of the tubing string permitting the control line to be aligned adjacent the tubular string prior to clamping.

In another embodiment, the method includes locating a guide boom at a location adjacent the tubular string, wherein the guide boom includes a guide member at an end thereof to guide the line. The method further includes locating a clamp boom at a location adjacent the tubular string, wherein the clamp boom includes a removable clamp. Additionally, the method includes clamping the line to the tubular string by utilizing the clamp and relocating the booms to a location away from the tubular string while leaving the line clamped to the tubular string.

BRIEF DESCRIPTION OF THE DRAWINGS

So that the manner in which the above recited features can be understood in detail, a more particular description is briefly summarized above, may be had by reference to embodiments, some of which are illustrated in the appended drawings. It is to be noted, however, that the appended drawings illustrate only typical embodiments and are therefore not to be considered limiting of scope, for the invention may admit to other equally effective embodiments.

DETAILED DESCRIPTION OF THE PREFERRED EMBODIMENT

Figure 1:
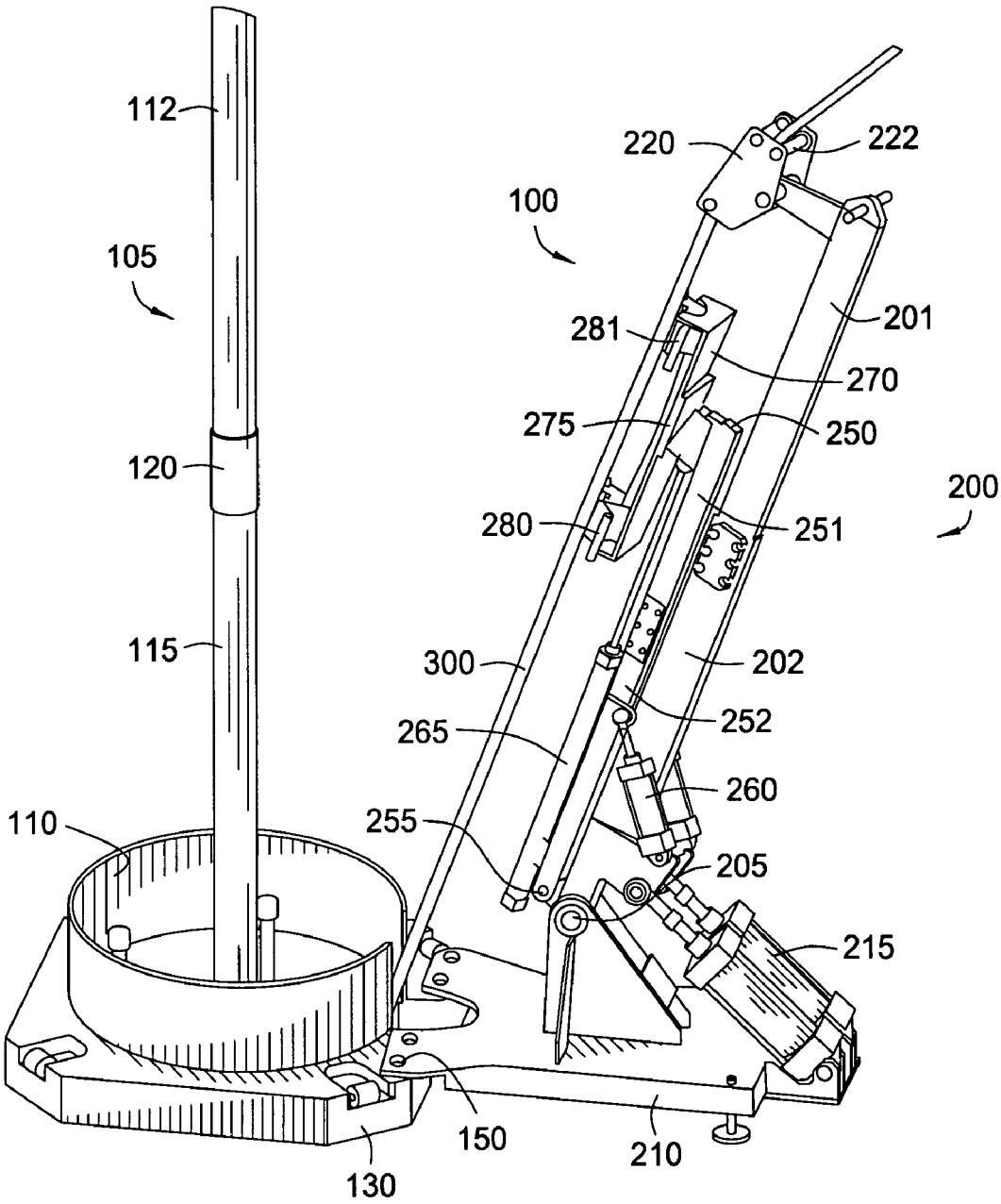
FIG. 1 illustrates one embodiment of an assembly used to facilitate the clamping of a control line to a tubular string.

FIG. 1 illustrates one embodiment of an assembly 100 used to facilitate the clamping of a control line 300 to a tubular string 105. The assembly 100 is movable between a staging position and a clamping position. As shown, the assembly 100 is located adjacent the surface of a well 110. Extending from the well 110 is the tubular string 105 comprising a first 112 and a second 115 tubulars connected by a coupling 120. Not visible in FIG. 1 is a spider which consists of slips that retain the weight of the tubular string 105 at the surface of the well 110. Also not shown in the Figure is an elevator or a spider which would typically be located above the rig floor or work surface to carry the weight of the tubular 112 as it is aligned and threadedly connected to the upper most tubular 115 to increase the length of tubular string 105. The general use of spiders and elevators to assemble strings of tubulars is well known and is shown in U.S. Publication No. US-2002/0170720-A1, which is incorporated herein by reference.

The assembly 100 includes a guide boom 200 or arm, which in one embodiment is a telescopic member made up of an upper 201 and a lower 202 boom. Guide boom 200 is mounted on a base 210 or mounting assembly at a pivot point 205. Typically, the guide boom 200 extends at an angle relative to the base 210, such as an angle greater than 30 degrees. A pair of fluid cylinders 215 or motive members permits the guide boom 200 to move in an arcuate pattern around the pivot point 205. Visible in FIG. 1 is a spatial relationship between the base 210 and a platform table 130. Using a fixing means, such as pins 150, the base 210 is fixed relative to the table 130, thereby permitting the guide boom 200 to be fixed relative to the tubular string 105 extending from the well 110 and preferably the guide boom 200 is fixed relatively proximate the tubular string 105 or well center. In this fashion, the vertical center line of the guide boom 200 is substantially aligned with the vertical center line of the tubular string 105, ensuring that as the guide boom 200 pivots around the pivot point 205 to approach the tubular string 105 (see FIG. 2) and subsequently causing the path of the boom 200 and the tubular string 105 to reliably intersect. This helps ensure that the control line 300 is close enough to the string 105 for a clamp 275 to be manually closed around the string 105 as described below.

As shown in FIG. 1, a guide 220 or a control line holding assembly is disposed at an upper end of guide boom 200. The guide boom 220 has a pair of rollers 222 mounted therein in a manner which permits the control line 300 to extend through the rollers 222.

Generally, the control line 300 is supplied from a reel (not shown) which is located proximate the guide boom 200 but far enough from the center of the well 110 to avoid interfering with the spider, elevator or draw works associated with the tubular string 105. The control line 300 can provide power or signals or both in any number of ways to a component or other device disposed in the well 110. Reels used to supply control lines are well known in the art and are typically pre-tensioned, whereby the control line will move off the reel as it is urged away from the reel while permitting the reel to keep some tension on the line and avoiding unnecessary slack.

Also visible in FIG. 1 is a clamp boom 250 or arm, which in one embodiment is a telescopic member made up of an upper 251 and a lower 252 boom. The clamp boom 250 is mounted substantially parallel to the guide boom 200. The clamp boom 250 includes a pivot point 255 adjacent the pivot point 205 of guide boom 200. The clamp boom 250 is moved by one or more fluid cylinders. For instance, a pair of fluid cylinders 260 moves the clamp boom 250 around the pivot point 255 away from the guide boom 200. Another fluid cylinder 265 causes the clamp boom 250 to lengthen or shorten in a telescopic fashion. Since the clamp boom 250 is arranged similarly to the guide boom 200, the clamp boom 250 also shares a center line with the tubular string 105. As defined herein, a fluid cylinder may be hydraulic or pneumatic. Alternatively, the booms 200, 250 may be moved by another form of a motive member such as a linear actuator, an electric or fluid operated motor or any other suitable means known in the art.

Figure 3:
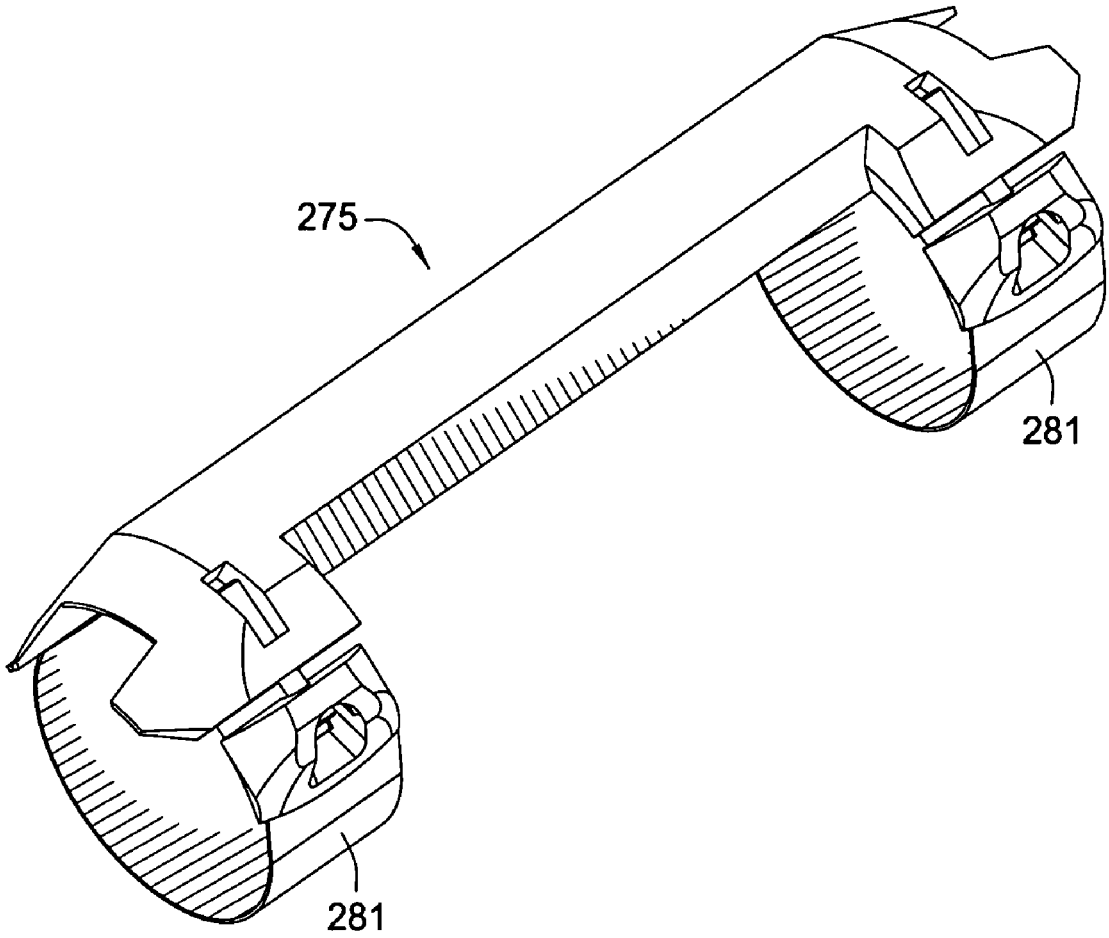
FIG. 3 is a detailed view of the clamp.

As shown in FIG. 1, a clamp holding assembly comprising a clamp housing 270 and a removable clamp 275 is disposed at an end of the clamp boom 250. The removable clamp 276 includes a first clamp member 280 and a second clamp member 281 which are designed to reach substantially around and embrace a tubular member, clamping, or securing a control line together with the tubular member. More specifically, the clamp 275 is designed to straddle the coupling 120 between two tubulars 112, 115 in the tubular string 105. For example, in the embodiment of FIG. 1, the clamp 275 is designed whereby one clamp member 281 will close around the lower end of tubular 112 and another clamp member 280 will close around an upper end of tubular 115, thereby straddling coupling 120. A frame portion between the clamp members 280, 281 covers the coupling 120. The result is a clamping arrangement securing the control line 300 to the tubular string 105 and providing protection to the control line 300 in the area of coupling 120. A more detailed view of the clamp 275 is shown in FIG. 3. In the preferred embodiment, the clamp 275 is temporarily held in the clamp housing 270 and then is releasable therefrom.

Figure 2:
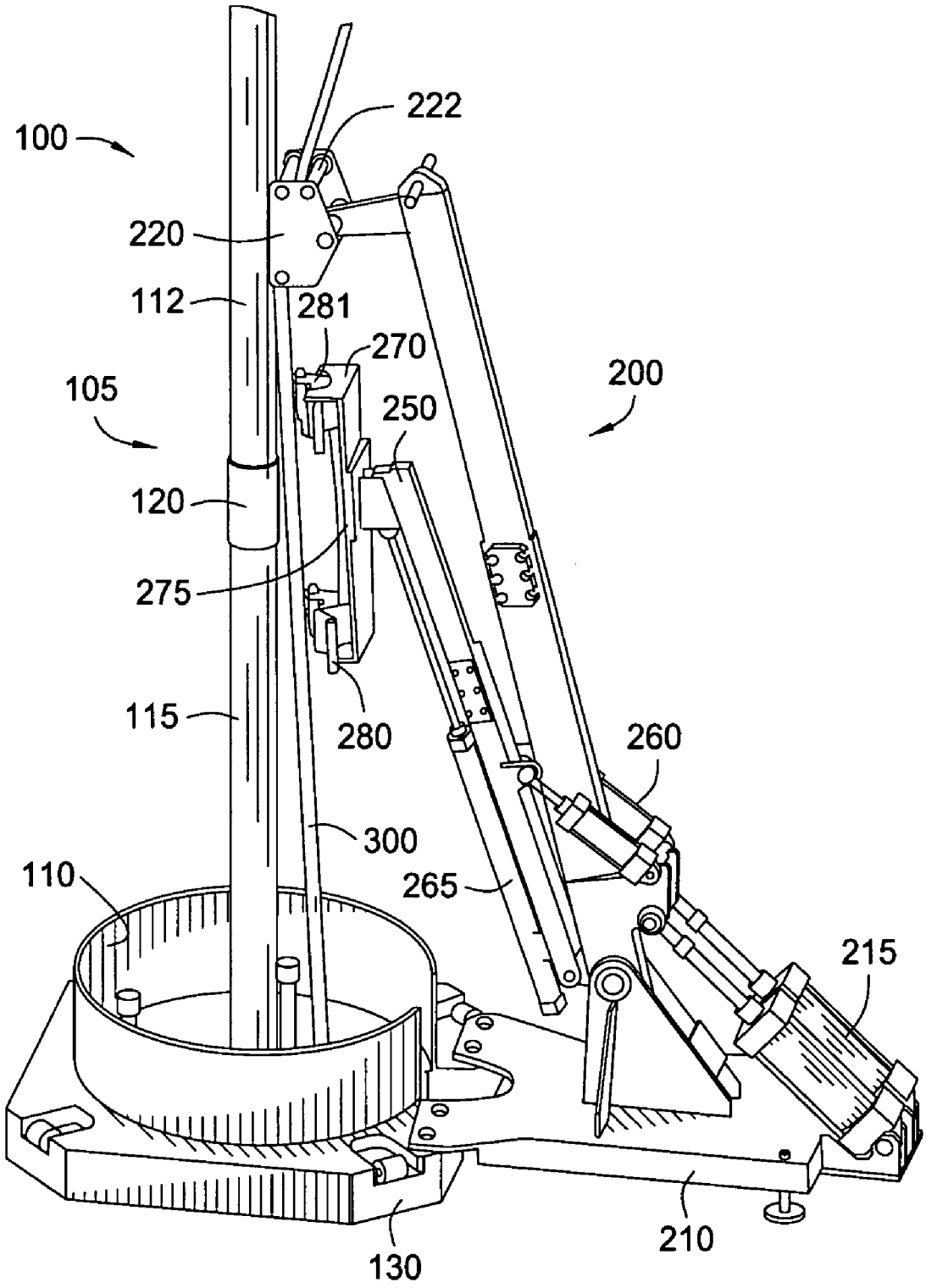
FIG. 2 illustrates the assembly of FIG. 1 in a position whereby the control line has been brought to a location adjacent the tubular string for the installation of a clamp.

FIG. 2 illustrates the assembly 100 in a position adjacent the tubular string 105 with the clamp 275 ready to engage the tubular string 105. Comparing the position of the assembly 100 in FIG. 2 with its position in FIG. 1, the guide boom 200 and the clamp boom 250 have both been moved in an arcuate motion around pivot point 205 by the action of fluid cylinders 215. Additionally, the cylinders 260 have urged the clamp boom 250 to pivot around the pivot point 255. The fluid cylinder 265 remains substantially in the same position as in FIG. 1, but as is apparent in FIG. 2, could be adjusted to ensure that coupling 120 is successfully straddled by the clamp 275 and that clamp members 280, 281 can be secured around tubulars 112 and 115, respectively. In FIG. 2, the guide 220 is in close contact with or touching tubular 112 to ensure that the control line 300 is running parallel and adjacent the tubular string 105 as the clamp boom 250 sets up the clamp 275 for installation. The quantity of control line 300 necessary to assume the position of FIG. 2 is removed from the pretensioned reel as previously described.

Still referring to FIG. 2, the clamp boom 250 is typically positioned close to the tubular string 105 by manipulating fluid cylinders 260 until the clamp members 280, 281 of the clamp 275 can be manually closed by an operator around tubulars 112 and 115. Thereafter, the clamp 275 is removed from the housing 270 either manually or by automated means and the assembly 100 can be retracted back to the position of FIG. 1. It should be noted that any number of clamps can be installed on the tubular string 105 using the assembly 100 and the clamps do not necessarily have to straddle a coupling.

In operation, the tubular string 105 is made at the surface of the well with subsequent pieces of tubular being connected together utilizing a coupling. Once a "joint" or connection between two tubulars is made, the string 105 is ready to be lowered into the wellbore to a point where a subsequent joint can be assembled. At that point, the guide boom 200 and the clamp boom 250 of the present invention are moved in an arcuate motion bringing the control line 300 into close contact and alignment with the tubular string 105. Thereafter, the cylinders 260 operating the clamp boom 250 are manipulated to ensure that the clamp 275 is close enough to the tubular string 105 to permit its closure by an operator and/or to ensure that the clamp members 280, 281 of the clamp 275 straddle the coupling 120 between the tubulars.

After the assembly 100 is positioned to associate the clamp 275 with tubular string 105, an operator closes the clamp members 280, 281 around the tubulars 112, 115 and thereby clamps the control line 300 to the tubulars 112, 115 in such a way that it is held fast and also protected, especially in the area of the coupling 120. Thereafter, the assembly 100 including the guide boom 200 and the clamp boom 250 is retracted along the same path to assume a retracted position like the one shown in FIG. 1. The tubular string 105 can now be lowered into the wellbore along with the control line 300 and another clamp can be loaded into the clamp housing 270.

In one embodiment, the guide boom and the clamp boom fluid cylinders are equipped with position sensors which are connected to a safety interlock system such that the spider can not be opened unless the guide boom 200 and the clamp boom 250 are in the retracted position. Alternatively such an interlock system may sense the proximity of the guide boom and clamp boom to the well center for example by either by monitoring the angular displacement of the booms with respect to the pivot points or by a proximity sensor mounted in the control line holding assembly or the clamp holding assembly to measure actual proximity of the booms to the tubular string. Regardless of the sensing mechanism used the sensor is in communication with the spider and/or elevator (or other tubular handling device) control system so that one of the spider or elevator must be engaged with the tubular (i.e. it is locked out from release) in order for the guide or clamp boom to approach the tubular and such a lock out remains until both guide and clamp booms are withdrawn.

Such an interlock system may also include the rig draw works controls. It is desirable that the tubular string not be raised or lowered while the control line or clamp booms are adjacent the string. The aforementioned boom position sensing mechanisms can be arranged to send signals (e.g. fluidic, electric, optic, sonic, or electromagnetic) to the draw works control system thereby locking the draw works (for example by locking the draw works brake mechanism in an activated position) when either the control line or clamp booms are in an operative position. Some specific mechanisms that may be used to interlock various tubular handling components and rig devices are described in U.S. Publication No. US-2004/00069500 and U.S. Pat. No. 6,742,596 which are incorporated herein in their entirety by reference.

Figure 4:
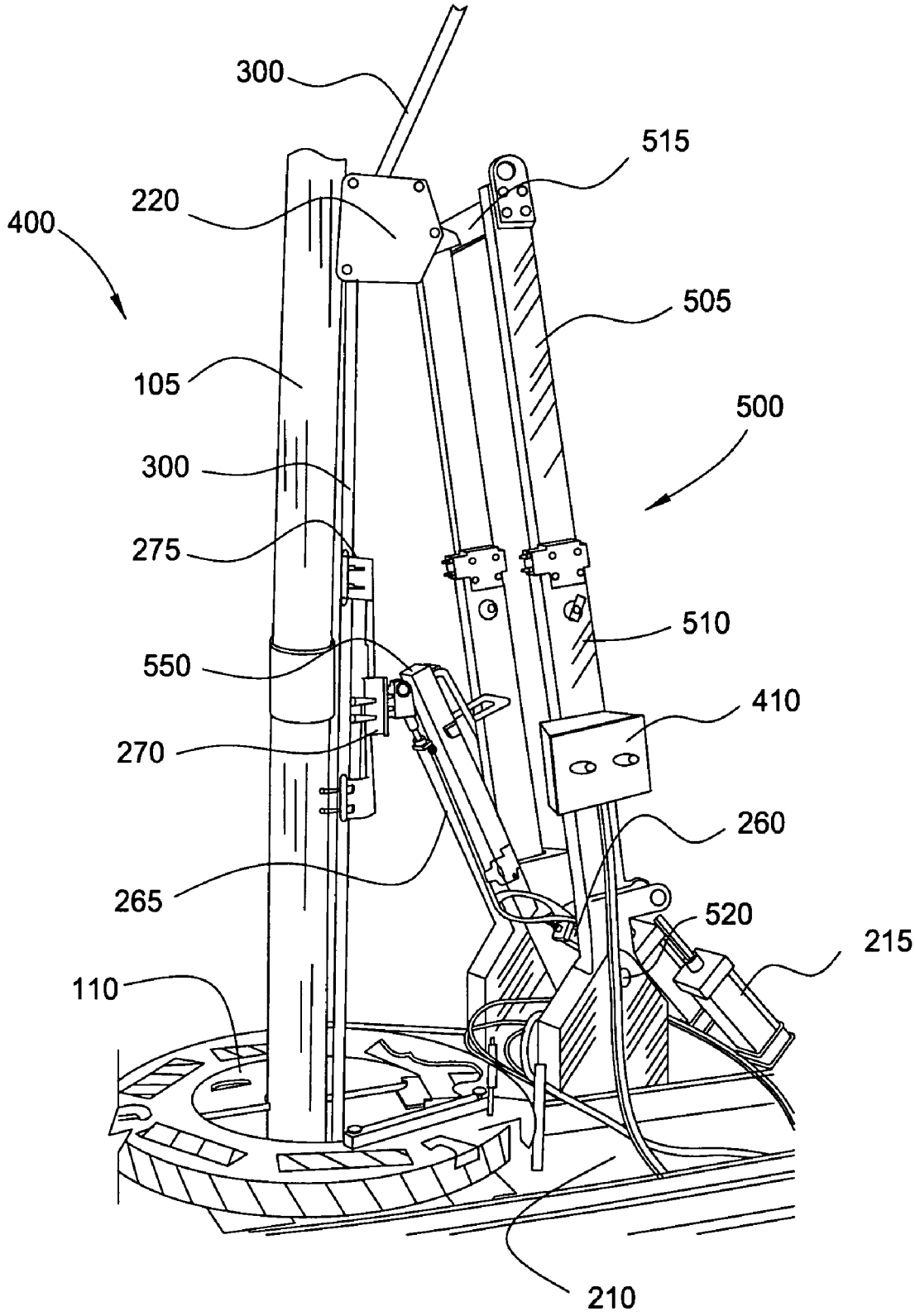
FIG. 4 illustrates another embodiment of an assembly used to facilitate the clamping of the control line to tubular string.

FIG. 4 illustrates another embodiment of an assembly 500 used to facilitate the clamping of the control line 300 to the tubular string 115. For convenience, the components in the assembly 400 that are similar to the components in the assembly 100 will be labeled with the same number indicator.

As illustrated, the assembly 400 includes a guide boom 500. The guide boom 500 operates in a similar manner as the guide boom 200 of assembly 100. However, as shown in FIG. 4, the guide boom 500 has a first boom 505 and a second boom 510 that are connected at an upper end thereof by a member 515. The member 515 supports the guide 220 at an end of the guide boom 500. Additionally, the guide boom 500 is mounted on the base 210 at pivot points 520. Similar to assembly 100, the pair of fluid cylinders 215 permits the guide boom 500 to move in an arcuate pattern around pivot points 520. In one embodiment, each boom 505, 510 may include an upper and a lower boom which are telescopically related to each other to allow the guide boom 500 to be extended and retracted in a telescopic manner.

Also visible in FIG. 4 is a clamp boom 550, which in one embodiment is a telescopic member made from an upper and a lower boom. The clamp boom 550 extends at an angle relative to the base 210 and is movable at least 100 degrees. The clamp boom 550 is mounted between the booms 505, 510 of the guide boom 500. The clamp boom 550 having a pivot point (not shown) adjacent the pivot points 520 of guide boom 500. Typically, the clamp boom 550 is manipulated by a plurality of fluid cylinders. For instance, a pair of fluid cylinders (not shown) causes the clamp boom 550 to move around the pivot point. Another fluid cylinder 265 causes the clamp boom 550 to lengthen or shorten in a telescopic fashion. The clamp boom 550 is positioned adjacent the tubular string 105 so that the clamp boom 550 shares a center line with the tubular string 105. In a similar manner as the clamp boom 250 in assembly 100, the clamp boom 550 includes the clamp assembly comprising the clamp housing 270 and the removable clamp 270 disposed at an end thereof.

Similar to the operation of assembly 100, the guide boom 500 and the clamp boom 550 of the assembly 400 are moved in an arcuate motion bringing the control line 300 into close contact and alignment with the tubular string 105. Thereafter, the cylinders 260 operating the clamp boom 550 are manipulated to ensure that the clamp 275 is close enough to the tubular string 105 to permit its closure by an operator.

After the assembly 400 is positioned adjacent the tubular string 105, the operator closes the clamp 275 around the tubular string 105 and thereby clamps the control line 300 to the tubular string 105 in such a way that it is held fast and also protected, especially if the clamp 275 straddles a coupling in the tubular string 105. Thereafter, the clamp boom 550 may be moved away from the control line 300 through a space defined by the booms 505, 510 of the guide boom 500 to a position that is a safe distance away from the tubular string 105 so that another clamp 275 can be loaded into the clamp housing 270.

The manipulation of either assembly 100 or assembly 400 may be done manually through a control panel 410 (shown on FIG. 4), a remote control console or by any other means know in the art. The general use of a remote control console is shown in U.S. Publication No. US-2004/0035587-A1, which has been incorporated herein by reference.

In one embodiment a remote console (not shown) may be provided with a user interface such as a joystick which may be spring biased to a central (neutral) position. When the operator displaces the joystick, a valve assembly (not shown) controls the flow of fluid to the appropriate fluid cylinder. As soon as the joystick is released, the appropriate boom stops in the position which it has obtained.

The assembly 100, 400 typically includes sensing devices for sensing the position of the boom. In particular, a linear transducer is incorporated in the various fluid cylinders that manipulate the booms. The linear transducers provide a signal indicative of the extension of the fluid cylinders which is transmitted to the operator's console.

In operation, the booms (remotely controllable heads) are moved in an arcuate motion bringing the control line into close contact and alignment with the tubular string. Thereafter, the cylinders operating the clamp boom are further manipulated to ensure that the clamp is close enough to the tubular string to permit the closure of the clamp. When the assembly is positioned adjacent the tubular string, the operator presses a button marked "memorize" on the console.

The clamp is then closed around the tubular string to secure the control line to the tubular string. Thereafter, the clamp boom and/or the guide boom are retracted along the same path to assume a retracted position. The tubular string can now be lowered into the wellbore along with the control line and another clamp can be loaded into the clamp housing.

After another the clamp is loaded in the clamp housing, the operator can simply press a button on the console marked "recall" and the clamp boom and/or guide boom immediately moves to their memorized position. This is accomplished by a control system (not shown) which manipulates the fluid cylinders until the signals from their respective linear transducers equal the signals memorized. The operator then checks the alignment of the clamp in relation to the tubular string. If they are correctly aligned, the clamp is closed around the tubular string. If they are not correctly aligned, the operator can make the necessary correction by moving the joystick on his console. When the booms are correctly aligned the operator can, if he chooses, update the memorized position. However, this step may be omitted if the operator believes that the deviation is due to the tubular not being straight.

While the foregoing embodiments contemplate fluid control with a manual user interface (i.e. joy stick) it will be appreciated that the control mechanism and user interface may vary without departing from relevant aspects of the inventions herein. Control may equally be facilitated by use of linear or rotary electric motors. The user interface may be a computer and may in fact include a computer program having an automation algorithm. Such a program may automatically set the initial boom location parameters using boom position sensor data as previously discussed herein. The algorithm may further calculate boom operational and staging position requirements based on sensor data from the other tubular handling equipment and thereby such a computer could control the safety interlocking functions of the tubular handling equipment and the properly synchronized operation of such equipment including the control line and clamp booms.

The aforementioned safety interlock and position memory features can be integrated such that the booms may automatically recall their previously set position unless a signal from the tubular handling equipment (e.g. spider/elevator, draw works) indicates that a reference piece of handling equipment is not properly engaged with the tubular.

While the assembly is shown being used with a rig having a spider in the rig floor, it is equally useful in situations when the spider is elevated above the rig floor for permit greater access to the tubular string being inserted into the well. In those instances, the assembly could be mounted on any surface adjacent to the tubular string. The general use of such an elevated spider is shown in U.S. No. 6,131,664, which is incorporated herein by reference. As shown in FIG. 1 of the '664 patent, the spider is located on a floor above the rig floor that is supported by two vertical wall members. In this arrangement, the apparatus could be mounted on the underside of the floor supporting the spider or on one of the adjacent walls.

Various modifications to the embodiments described are envisaged. For example, the positioning of the clamp boom to a predetermined location for loading a clamp into the clamp housing could be highly automated with minimal visual verification. Additionally, as described herein, the position of the booms is memorized electronically, however, the position of the booms could also be memorized mechanically or optically.

While the foregoing is directed to embodiments other and further embodiments may be devised without departing from the basic scope thereof, and the scope thereof is determined by the claims that follow.

The invention claimed is:

1. A control line positioning apparatus comprising:

a control line holding assembly movable between a staging position and a clamping position;

a mounting assembly for connecting the control line holding assembly to a rig structure, the rig structure having a rig floor and the mounting assembly located substantially adjacent the rig floor;

a motive member for moving the control line holding assembly between the staging position and the clamping position; and an arm for connecting the control line holding assembly to the mounting assembly, wherein the arm extends at an angle relative to the rig floor when the control line holding assembly is in the clamping position.

2. The apparatus of claim 1, wherein the angle relative is greater than 30 degrees.

3. The apparatus of claim 1, wherein the mounting assembly is connected to the rig floor.

4. The apparatus of claim 1, further including a clamp holding assembly movable between a second staging position and a second clamping position.

5. The apparatus of claim 4, further including a second motive member for moving the clamp holding assembly between the second staging position and the second clamping position.

6. The apparatus of claim 5, wherein the second motive member is a fluid operated cylinder.

7. The apparatus of claim 4, wherein the clamp holding assembly is movable independently of the control line holding assembly.

8. The apparatus of claim 4, further including a second arm for connecting the clamp holding assembly to the mounting assembly.

9. The apparatus of claim 8, wherein the second arm extends at an angle relative to the rig floor.

10. The apparatus of claim 9, wherein the second arm is moveable through an arc describing at least 100 degrees.

11. The apparatus of claim 8, wherein the second arm is extendable independent of the first arm.

12. The apparatus of claim 4, further including a clamp for securing the control line to a tubular string.

13. The apparatus of claim 1, wherein the rig structure includes a well center and the apparatus is arranged and configured such that the mounting assembly is closer to the well center than the control line holding assembly when the control line holding assembly is in the staging position.

14. The apparatus of claim 1, wherein a movement of the control line holding assembly describes an arc that substantially intersects with a center line of a tubular string.

15. The apparatus of claim 1, wherein the control line holding assembly is constructed and arranged to position the control line substantially parallel with a tubular string.

16. The apparatus of claim 1, wherein the motive member is a fluid cylinder.

17. A method of operating a control line positioning apparatus comprising:

moving a control line holding assembly from a staging position to a clamping position, wherein the control line holding assembly is operatively mounted proximate a floor of a rig with a mounting assembly;

holding a control line adjacent a tubular string with the control line holding assembly;

securing the control line to the tubular string; and relocating the control line holding assembly away from the tubular string.

18. The method of claim 17, wherein the control line holding assembly and the mounting assembly are connected by an arm that extends at an angle relative to the rig floor.

19. The method of claim 17, further including a clamp holding assembly.

20. The method of claim 19, further including moving the clamp holding assembly through an arc describing at least 100 degrees.

21. The method of claim 19, wherein the clamp holding assembly is attached to the rig floor by a second arm.

22. The method of claim 21, further including extending the second arm relative to the first arm.

23. The method of claim 17, wherein the clamp holding assembly includes a clamp.

24. The method of claim 23, further including positioning the clamp over a coupling in the tubular string.

25. The method of claim 17, further including sensing an operative condition of at least one other tubular handling device of the rig and controlling the control line holding assembly in response to the sensed operative condition.

26. The method of claim 25, wherein the controlling is achieved by automatic feedback of the sensed operative condition into a control system.

27. The method of claim 17, further including sensing an operative condition of the control line holding assembly and controlling at least one other tubular handling device of the rig in response to the sensed operative condition.

28. The method of claim 27, wherein the controlling is achieved by automatic feedback of the sensed operative condition into a control system.

29. A method for running a well pipe into a well with control lines attached to the pipe, comprising:

securing a pipe with a spider located above a rig floor;

providing a control line alignment apparatus having a mounting member, a control line engagement member and a motive member for moving the engagement member relative to the mounting member;

using the control line alignment apparatus to align the control line with the pipe at a location below the spider and above the rig floor;

securing the control line to the pipe below the spider; and lowering the pipe and secured control line into the well.

30. The method of claim 29, wherein the control alignment apparatus further includes an arm for connecting the control arm engagement member to the mounting member.

31. The method of claim 30, wherein the arm is angled at least 45 degrees relative to the rig floor.

32. The method of claim 31, wherein the control alignment apparatus further includes a clamp holder assembly for securing the control line to the well pipe.

33. The method of claim 32, further including rotating the clamp holder through an arc describing at least 100 degrees.

34. A method of aligning a control line with a tubular, comprising:

positioning a control line using a remotely controllable head;

determining a position of the head, wherein the position of the head aligns a first portion of the control line with a tubular string;

memorizing the position of the head; and positioning a second portion of the control line using the memorized position.

35. The method of claim 34, wherein the remotely controllable head is attached to a rig floor by an arm that extends at an angle relative to the rig floor.

36. The method of claim 35, wherein the angle relative is at least 45 degrees.

37. The method of claim 34, further including securing the control line to the tubular.

38. An apparatus for positioning a control line adjacent a tubular string, the apparatus comprising:

a guide boom pivotable around a location adjacent the tubular string, the boom including a guide member at an end thereof to guide the control line; and a clamp boom independently pivotable from substantially the same location as the guide boom, the clamp boom having a clamp assembly at an end thereof for clamping the line against the tubular.

* * * * *